US008465112B2

(12) United States Patent
Kondoh

(10) Patent No.: US 8,465,112 B2
(45) Date of Patent: Jun. 18, 2013

(54) DROPLET EJECTING APPARATUS AND CURRENT CONTROL METHOD

(75) Inventor: Yoshinao Kondoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/216,363

(22) Filed: Aug. 24, 2011

(65) Prior Publication Data

US 2011/0304663 A1 Dec. 15, 2011

Related U.S. Application Data

(62) Division of application No. 12/901,612, filed on Oct. 11, 2010, now Pat. No. 8,038,242, which is a division of application No. 11/347,607, filed on Feb. 3, 2006, now Pat. No. 7,850,264.

(30) Foreign Application Priority Data

Aug. 24, 2005 (JP) ..... 2005-242708

(51) Int. Cl.
*B41J 29/38* (2006.01)

(52) U.S. Cl.
USPC ..... 347/9; 347/11; 347/14

(58) Field of Classification Search
USPC ..... 347/9, 11, 14
See application file for complete search history.

(56) References Cited

U.S. PATENT DOCUMENTS

| | | | |
|---|---|---|---|
| 6,437,964 | B1 | 8/2002 | Takamura et al. |
| 2001/0026292 | A1 | 10/2001 | Ishizaki |
| 2004/0095437 | A1 | 5/2004 | Kim et al. |
| 2004/0196334 | A1 | 10/2004 | Cornell |

FOREIGN PATENT DOCUMENTS

| | | |
|---|---|---|
| JP | 3104304 | 9/2000 |
| JP | 2002-094364 | 3/2002 |

*Primary Examiner* — Jannelle M Lebron
(74) *Attorney, Agent, or Firm* — Fildes & Outland, P.C.

(57) ABSTRACT

A droplet ejecting component of the present invention includes an ejecting component having a charge and discharge characteristic, an applying component being provided with a transistor, and an increasing component. The ejecting component ejects a droplet. When a control signal is inputted, the applying component applies an application voltage to the ejecting component, and the increasing component increases the impedance of the transistor.

2 Claims, 10 Drawing Sheets

DROPLET EJECTING APPARATUS AND CURRENT CONTROL METHOD

CROSS-REFERENCE TO RELATED APPLICATION

This application is a division of U.S. application Ser. No. 12/901,612 filed Oct. 11, 2010 which is a division of U.S. application Ser. No. 11/347,607 filed Feb. 3, 2006, which claims priority under 35 USC 119 from Japanese Patent Application No. 2005-242708, the disclosure of which is incorporated by reference herein.

BACKGROUND OF THE INVENTION

1. Field of the Invention

The present invention relates to a droplet ejecting apparatus and a current control method, and particularly to a droplet ejecting apparatus and current control method for ejecting a droplet from an ejecting component.

2. Description of the Related Art

There have conventionally been known inkjet recording devices (so-called inkjet printers) having an ink jet recording head which, by using an actuator structured by a piezoelectric element or the like, changes the volume of (expands or contracts) a pressure generating chamber in which ink is filled, and, due to the change in pressure at the interior of the chamber caused by this change in volume, causes an ink drop to be ejected from the distal end of a nozzle which is formed to communicate with the pressure generating chamber.

The trend toward increasing the printing speeds of inkjet recording devices has strengthened in recent years. To this end, inkjet recording heads have come to be used in which the inkjet recording head is made to be longer, the number of nozzles per inkjet recording head is increased, and the nozzles are disposed so as to be arrayed in the form of a matrix, thereby enabling image formation over a wide region in a shorter period of time.

Thus, when the inkjet recording head is lengthened further than the width of a recording sheet, the inkjet recording head is provided with many ejectors formed from the above-described pressure generating chambers, nozzles, and the like.

In the case where the piezoelectric element is pulse-driven, an extremely large instant current is required when starting the drive of the piezoelectric element. Since the piezoelectric elements are simultaneously driven in the inkjet recording head, the total current is increased excessively when the current for starting the drive of the piezoelectric element is large.

For example it is assumed that a piezoelectric element having an electrostatic capacity of 600 pF is pulse-driven by power supply voltage of 20V while the pulse has a rise time of 1 μs. In this case, assuming that instant maximum current is about 30 mA and the inkjet recording head has the 1024 ejectors, the total current becomes about 30 A, so that maximum power supply capacity of about 600 VA is instantaneously required.

Thus, in the conventional inkjet recording head, the challenge has been to decrease the instant passage of the current through the piezoelectric element when starting the drive of the piezoelectric element.

Conventionally the rise time during which the voltage is applied to the piezoelectric element in starting the drive is lengthened in order to solve the problem (see Japanese Patent No. 3104304). However, in consideration of the generation of the small-diameter droplets (discharge: generation start to charge: cutting tail portion), the rise time cannot be lengthened too long. Particularly, for an ejector in which the pressure chamber is compressed by the charge, the desired droplet cannot be generated when the rise time is excessively long.

It is also thought that the charge and discharge are performed while output impedance of a drive circuit is decreased stepwise (see Japanese Patent Application Laid-Open No. 2002-094364). However, spike current is generated in the switching, and there is a possibility that the instant passage of the maximum current through the piezoelectric element is, conversely, increased.

SUMMARY OF THE INVENTION

The present invention has been made in view of the above circumstances and provides a droplet ejecting apparatus and a current control method.

A first aspect of the invention is a droplet ejecting component including an ejecting component which ejects a droplet, the ejecting component having a charge and discharge characteristic; an applying component which applies an application voltage to the ejecting component when a control signal is inputted, the applying component being provided with a transistor; and an increasing component which increases the impedance of the transistor.

A second aspect of the invention is a current control method in which passage of current through an ejecting component is controlled in a starting drive of a droplet ejecting component including the ejecting component, an applying component, and an increasing component, wherein the ejecting component has a charge and discharge characteristic, and the ejecting component ejects a droplet, the applying component is provided with a transistor, the applying component applies an application voltage to the ejecting component when a control signal is inputted, and the increasing component increases the impedance of the transistor.

BRIEF DESCRIPTION OF THE DRAWINGS

Embodiments of the present invention will be described in detail based on the following figures, wherein.

DETAILED DESCRIPTION OF THE INVENTION

Embodiments of the present invention will be described in detail hereinafter with reference to the drawings.

Figure 1:
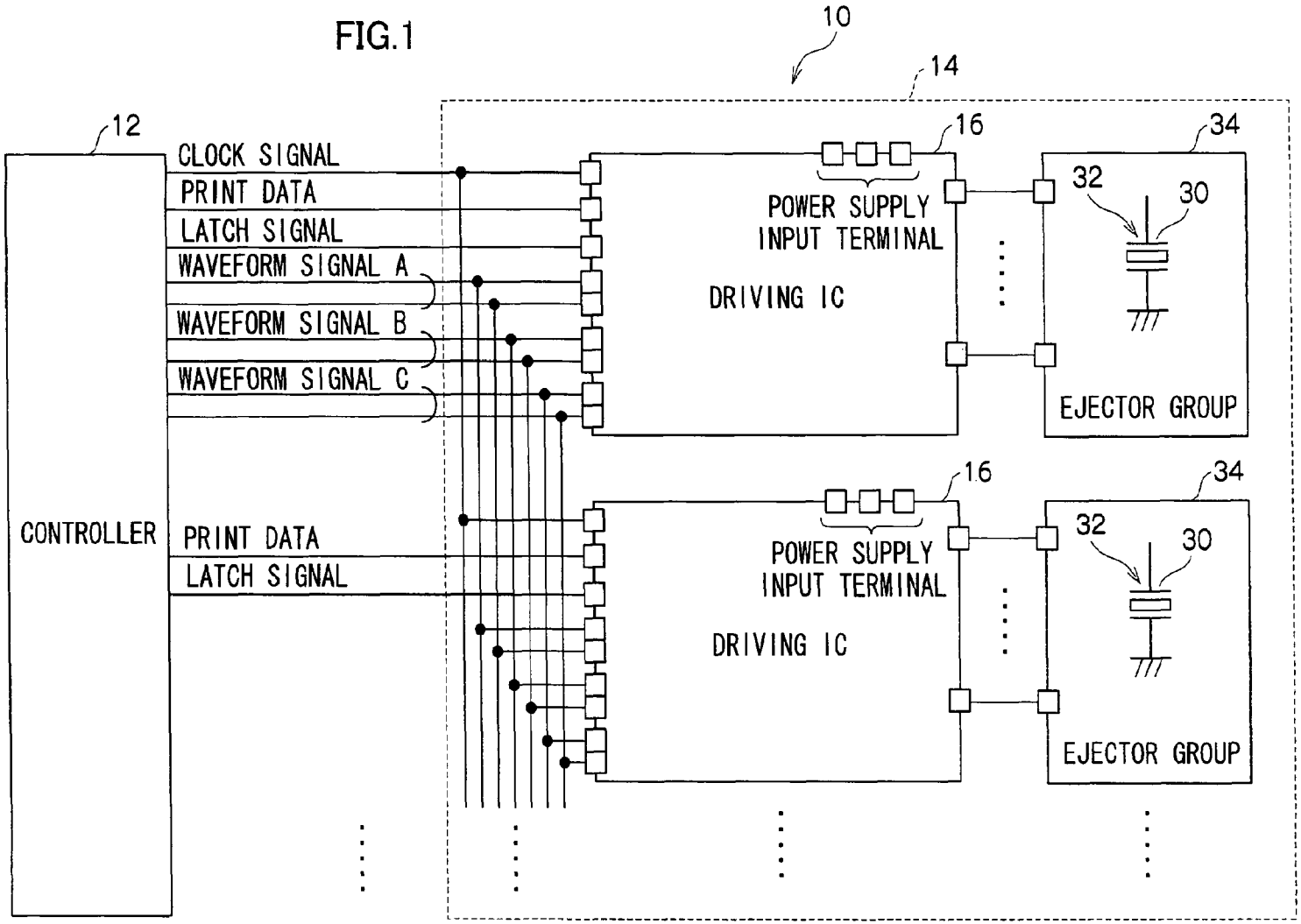
FIG. 1 is a schematic view showing the main components of an inkjet recording device according to a first embodiment of the present invention.

FIG. 1 is a diagram showing the main components of the inkjet recording device 10 as a droplet ejecting component according to the first embodiment of the present invention. The main components in the vicinity of the inkjet recording head, except for a recording sheet conveying system, are illustrated in FIG. 1.

As shown in FIG. 1, the inkjet recording device 10 according to the present embodiment has a controller 12 as a controlling component, which governs the operations of the entire inkjet recording device 10, and an inkjet recording head 14, which ejects ink drops on the basis of supplied print data. The inkjet recording head 14 has plural ejector groups 34 and driving ICs (Integrated Circuits) 16. The ejector groups 34 are structured such that plural ejectors 32 are arranged two-dimensionally. The ejectors 32 eject ink drops due to the deformation of piezoelectric elements (piezo elements) 30 provided individually thereat as ejecting components. The driving ICs 16 are provided as driving circuits so as to correspond to the respective ejector groups 34.

The inkjet recording head 14 relating to the present embodiment is an elongated structure whose width is substantially equal to the width of a recording sheet. Namely, the present inkjet recording device 10 is structured as a so-called FWA (Full-Width Array) type inkjet recording device which carries out recording while conveying only the recording sheet with the inkjet recording head 14 remaining fixed.

The ejector 32 relating to the present embodiment is structured so as to include: a pressure generating chamber into which ink is filled; an ink ejecting opening which communicates with the pressure generating chamber and which can eject ink; and an actuator which has a vibrating plate structuring a portion of a wall surface of the pressure generating chamber and expanding or contracting the pressure generating chamber by vibrating, and has the piezoelectric element 30 which vibrates the vibrating plate by deforming due to voltage applied thereto in accordance with image data expressing the image to be recorded.

All of the driving ICs 16 provided at the inkjet recording head 14 are connected to the controller 12. The control of the operations of the driving ICs 16 is carried out by the controller 12 by using clock signals, print data, and latch signals, as well as a waveform signal A, a waveform signal B and a waveform signal C, each of which is a pair of signals, and the like.

Figure 2:
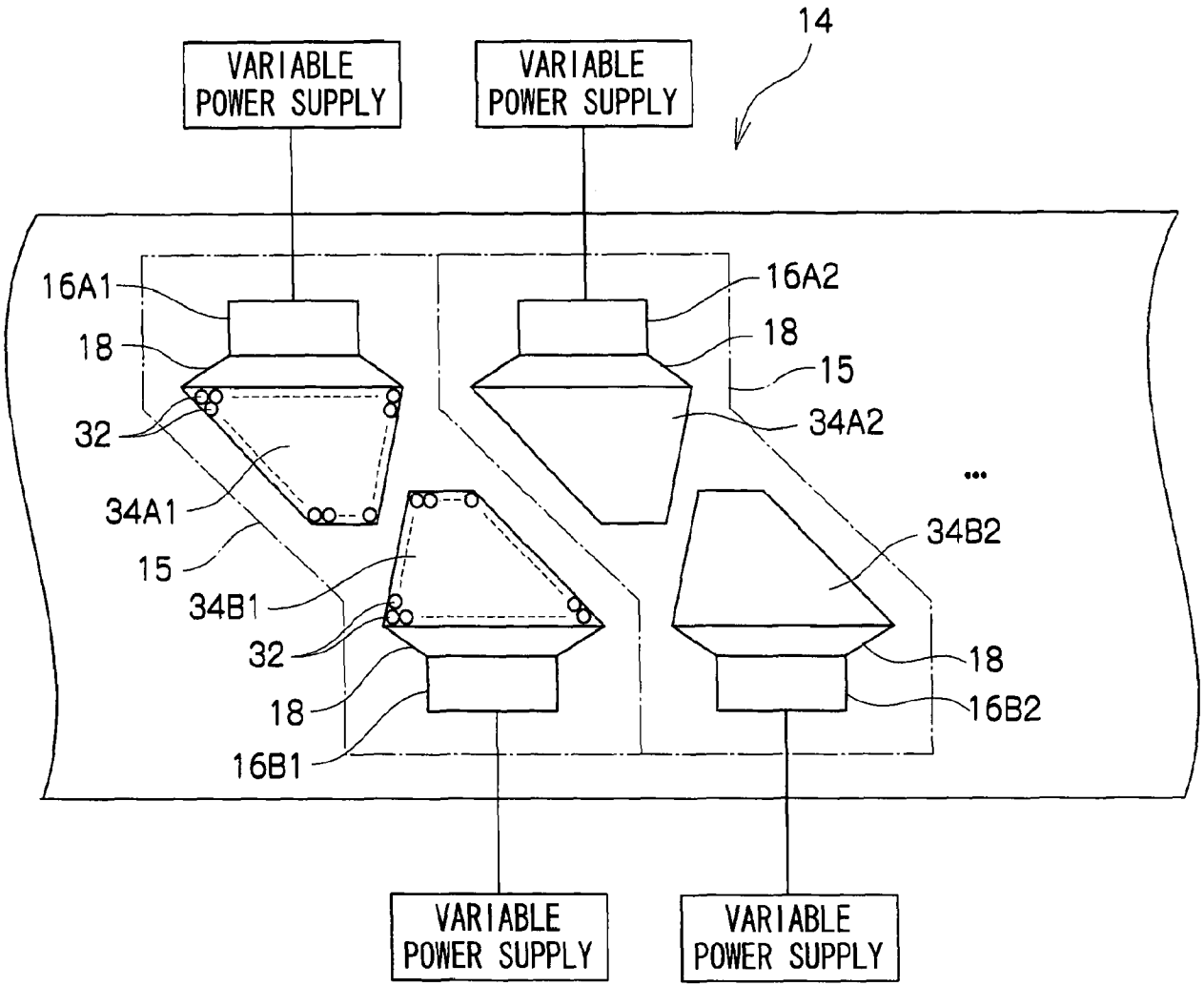
FIG. 2 is a plan view showing a schematic structure of an inkjet recording head according to the first embodiment of the present invention.

A plan view showing the schematic structure of the inkjet recording head 14 according to the present embodiment is shown in FIG. 2.

As shown in FIG. 2, at the inkjet recording head 14 according to the present embodiment, each of ejector groups 34A1, 34B1, 34A2, 34B2, . . . , which are structured by plural ejectors 32 arranged two-dimensionally, is a unit structure. The plural unit structures are disposed, with respect to one predetermined direction (the longitudinal direction (elongated direction) of the inkjet recording head 14), such that partial regions at the end portions of the ejector groups which are disposed at adjacent unit structures, overlap one another.

The driving ICs 16A1, 16B1, 16A2, 16B2 . . . are provided individually in one-to-one correspondence with the ejector groups 34A1, 34B1, 34A2, 34B2, . . . . An ejector group and the corresponding driving IC are electrically connected by a connecting wire 18. Hereinafter, the ejector groups 34A1, 34B1, 34A2, 34B2, . . . may be abbreviated as "the ejector group 34", other than in cases of designating a specific ejector group.

Further, hereinafter, the driving ICs 16A1, 16B1, 16A2, 16B2 . . . may be abbreviated as "the driving IC 16", other than in cases of designating a specific driving IC. Note that voltage is applied to respective ICs 16 from a variable power supply which will be described below.

The configuration of the region where the ejector group 34 according to the present embodiment is disposed is a trapezoidal configuration in which the angles of the two inclined sides connecting the upper and lower sides are different from one another. Further, in the inkjet recording head 14 according to the present embodiment, the respective upper sides of the pair of ejector groups 34 are disposed so as to oppose one another across a longitudinal direction central line of the inkjet recording head 14, with the corresponding ICs 16 being disposed integrally therewith, to structure a head unit 15 as a unit part. The inkjet recording head 14 is structured in a state in which plural head units 15 are arrayed in the longitudinal direction.

Figure 3:
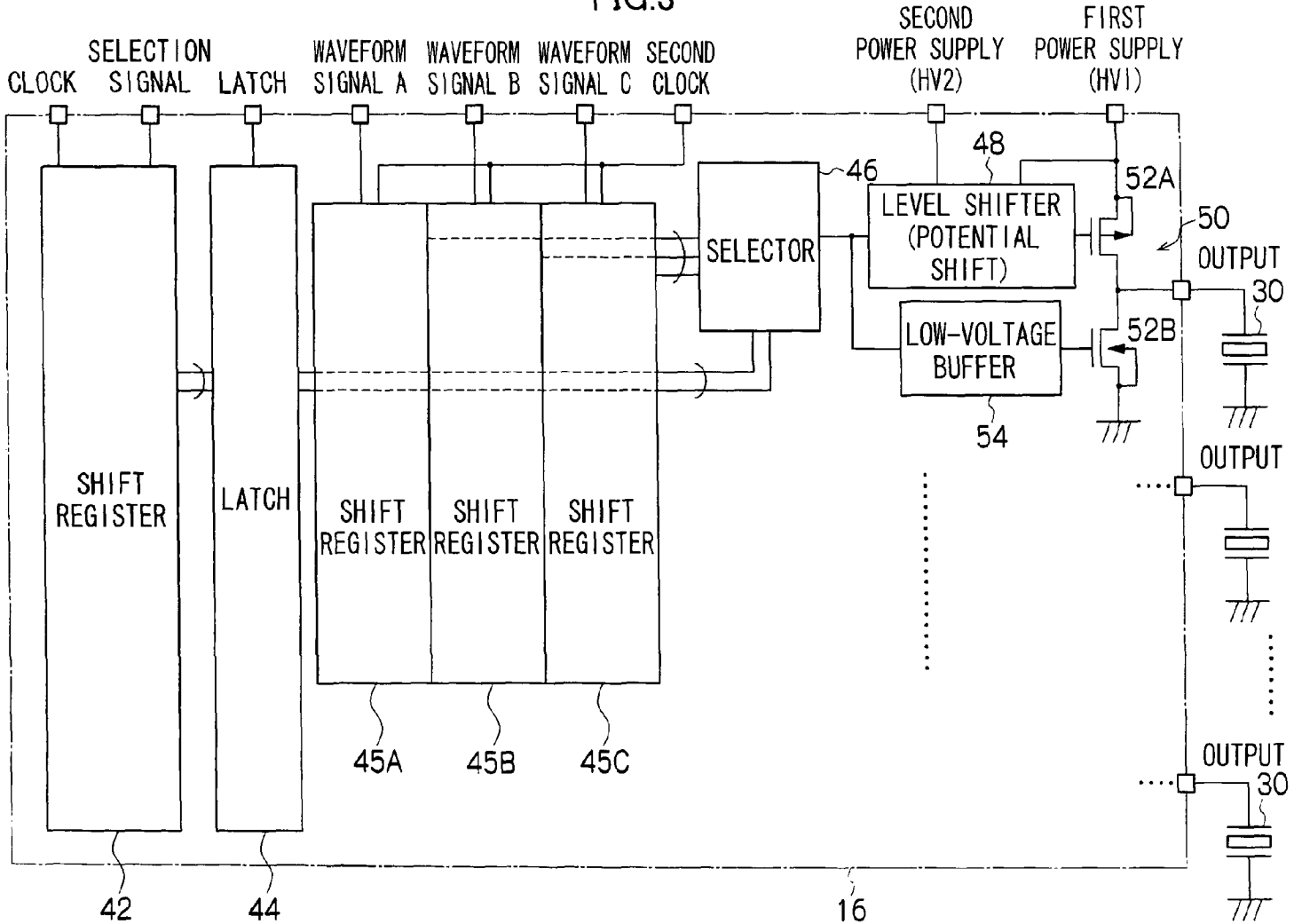
FIG. 3 is a block diagram (partially including a circuit diagram) showing the main components of a driving IC according to the first embodiment of the present invention.

The structure of the driving IC 16 according to the present embodiment is shown in FIG. 3.

As shown in FIG. 3, the driving IC 16 according to the present embodiment has a shift register 42, a latch circuit 44, shift registers 45A to 45C, a selector 46, a level shifter 48, a charge and discharge driving circuit 50, and a low-voltage buffer 54.

A clock signal and print data outputted from the controller 12 are inputted to the shift register 42, and a latch signal is inputted to the latch circuit 44.

The print data are 2-bit serial data for selecting any one (pair of signals) of the waveform signal A, the waveform signal B, and the waveform signal C. For example, when the waveform signal A is selected, the print data are "11". When the waveform signal B is selected, the print data are "10". When the waveform signal C is selected, the print data are "01". When no waveform is selected, the print data are "00".

Note that, hereinafter, explanation will be given of a case in which a driving waveform is supplied to a single piezoelectric element 30. However, the same holds for the other piezoelectric elements 30 as well, and therefore, description relating to the other piezoelectric elements 30 will be omitted.

The shift register 42 converts the inputted print data, which is the 2-bit serial data, into 2-bit parallel data, and outputs the parallel data to the latch circuit 44.

In accordance with the input of a latch signal, the latch circuit 44 latches (self-holds) the parallel data outputted from the shift register 42.

The waveform signal A, the waveform signal B, and the waveform signal C from the controller 12 are formed in advance as a large droplet signal, a mid-sized droplet signal, and a small droplet signal respectively. The waveform signal A, the waveform signal B, and the waveform signal C are inputted to the shift registers 45A, 45B, and 45C respectively.

The shift registers 45A, 45B, and 45C are used in order to shift drive timing. That is, in the embodiment, a group of piezoelectric elements is divided into blocks. For example, a trapezoidal group of ejectors (one group includes 512 ejectors) is divided into 32 blocks, and each block has 16 ejectors. The number of steps in each of the shift registers 45A, 45B, and 45C corresponds to the number of blocks (32). The drive timing of each block is shifted by a second clock. For a frequency of 10 MHz, the shift time is 0.1 μs and the total shift time is 3.2 μs (drive time≧20 μs).

The selector 46 selects one of the predetermined step outputs of the shift registers 45A, 45B, and 45C according to the output of the latched shift register 42, and the selector 46 outputs the selected signal (drive instruction signal) to the level shifter 48.

Voltage HV1 from a first power supply and voltage HV2 from a second power supply are applied to the level shifter 48, and the level shifter 48 converts the inputted signal into a control signal having a predetermined amplitude and outputs the control signal to the charge and discharge driving circuit 50.

The voltage HV1 and the voltage HV2 may be set at fixed values, or the voltage HV1 and the voltage HV2 may be changed according to environmental conditions such as temperature. It is not necessary to fix a potential difference between the voltage HV1 and the voltage HV2.

Figure 4:
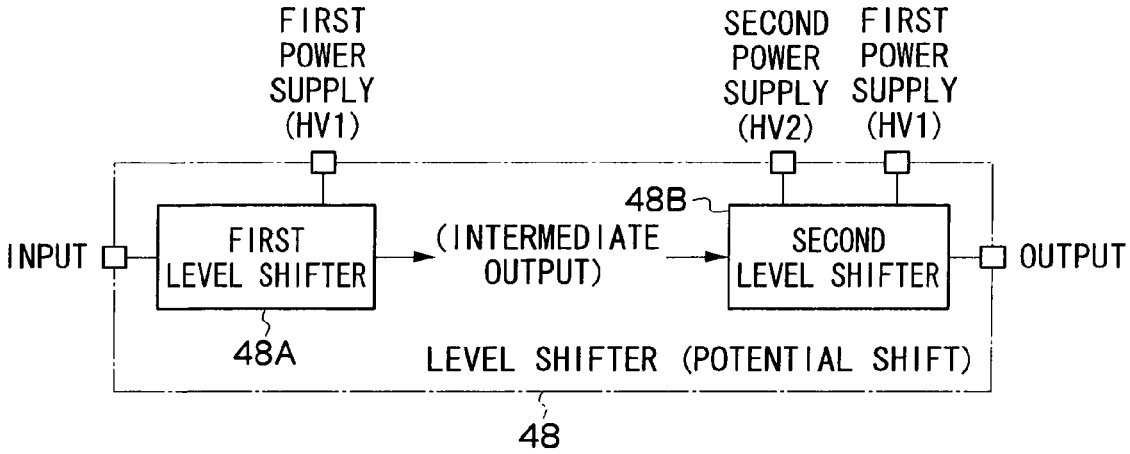
FIG. 4 is a block diagram of a level shifter.
Figure 5:
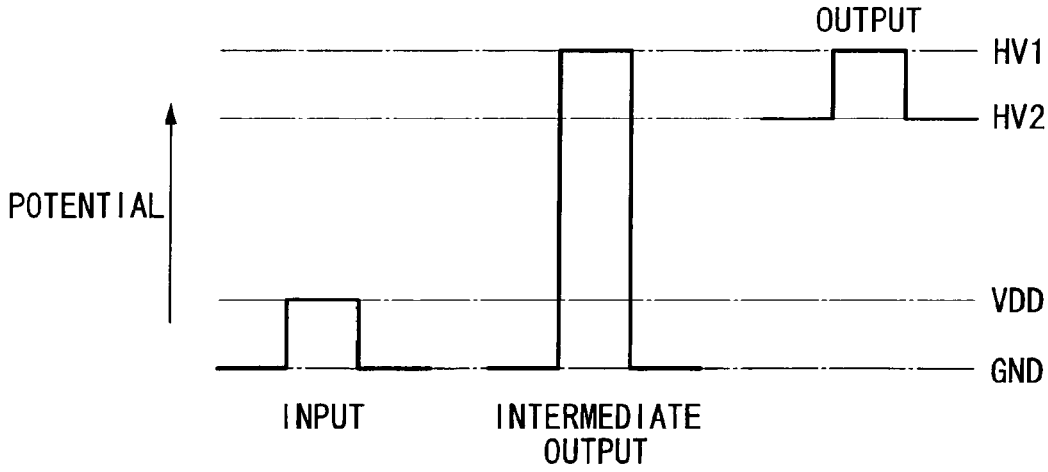
FIG. 5 is a diagram showing a state in which signal amplitude is changed by the level shifter.

As shown in FIGS. 4 and 5, the level shifter 48 includes a first level shifter 48A as a first potential converting component and a second level shifter 48B as a second potential converting component. The first level shifter 48A converts a maximum potential VDD of the signal (drive instruction signal) into a potential not lower than HV1 (in the first embodiment, the maximum potential VDD is HV1) when the signal is inputted from the selector 46. The second level shifter 48B converts a minimum potential GND of the signal (intermediate output) in which the maximum potential has been converted by the first level shifter 48A, into the potential HV2 larger than the minimum potential GND of HV1.

Next, the first level shifter 48A and the second level shifter 48B will be described in further detail with reference to FIG. 6.

Figure 6:
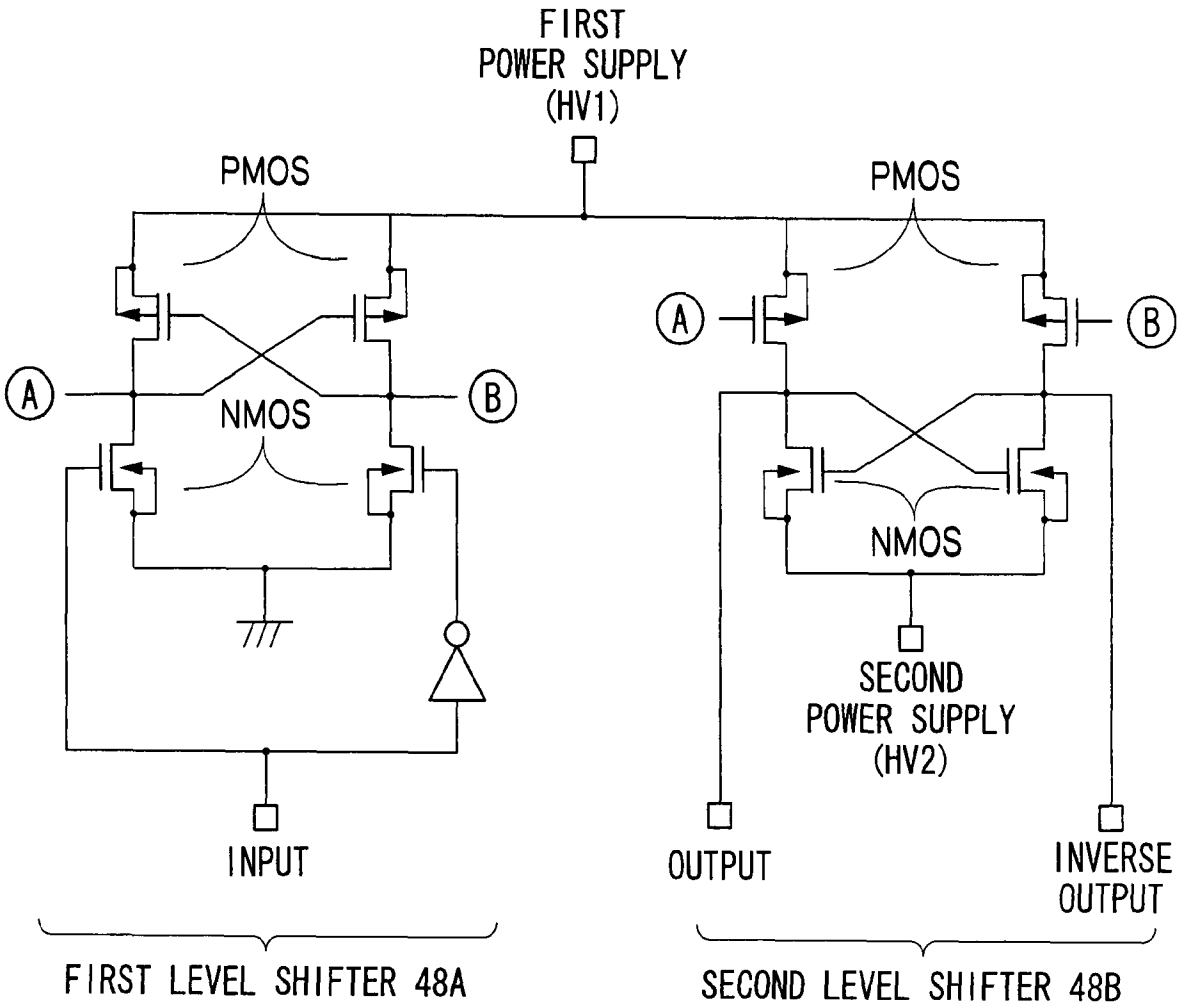
FIG. 6 is a circuit diagram of the level shifter.

As shown in FIG. 6, a circuit configuration in which two sets of series circuits are used is applied to each of the first level shifter 48A and the second level shifter 48B. In each series circuit, a source side of a P-channel MOS FET (hereinafter referred to as "PMOS") is connected to a drain side of an N-channel MOS FET (hereinafter referred to as "NMOS").

In the first level shifter 48A, the drain side of the PMOS is connected to the first power supply, and the source side of the NMOS is connected to GND. Each of the gates of the PMOSs in the two sets of series circuits is connected to the source side of the other PMOS, and each of the sources of the PMOSs in the two sets of series circuits is connected to the gate of the PMOS in the second level shifter 48B (see A and B).

In the second level shifter 48B, the drain side of the PMOS is connected to the first power supply, and the source side of the NMOS is connected to the second power supply. Each of the gates of the NMOSs in the two sets of series circuits is connected to the drain side of the other NMOS, and the source of one of the PMOSs in the two sets of series circuits is connected to the charge and discharge driving circuit 50.

When the signal (drive instruction signal) is inputted from the selector 46 as mentioned above, the first level shifter 48A converts the maximum potential VDD of the signal into HV1 with reference to GND. The signal (intermediate output) is inputted to the gate of the second level shifter 48B. The second level shifter 48B converts the minimum potential GND of the signal (intermediate output) into the potential HV2 with reference to HV1 to generate the control signal, and the second level shifter 48B outputs the control signal to the charge and discharge driving circuit 50.

Thus, the control signal has an amplitude smaller than that of the voltage HV1 of the first power supply. That is, the maximum potential is the voltage HV1 and the minimum potential is HV2, which is larger than the minimum potential GND of HV1.

As shown in FIG. 3, the charge and discharge driving circuit 50 includes the series circuit in which the source side of the PMOS and the drain side of the NMOS are connected to each other. The level shifter 48 is connected to the gate of the PMOS. One end of the low-voltage buffer 54 is connected to the gate of the NMOS while the other end is connected to the selector 46. The source of the PMOS is connected to the piezoelectric element 30.

The charge and discharge driving circuit 50 applies the application voltage (HV1) to the piezoelectric element 30 when the control signal is inputted.

In order to turn on the PMOS used in the charge and discharge driving circuit 50, usually, since it is necessary that the maximum potential be larger than the application voltage HV1, the amplitude of the control signal is set at the same amplitude as the application voltage HV1.

Figure 7:
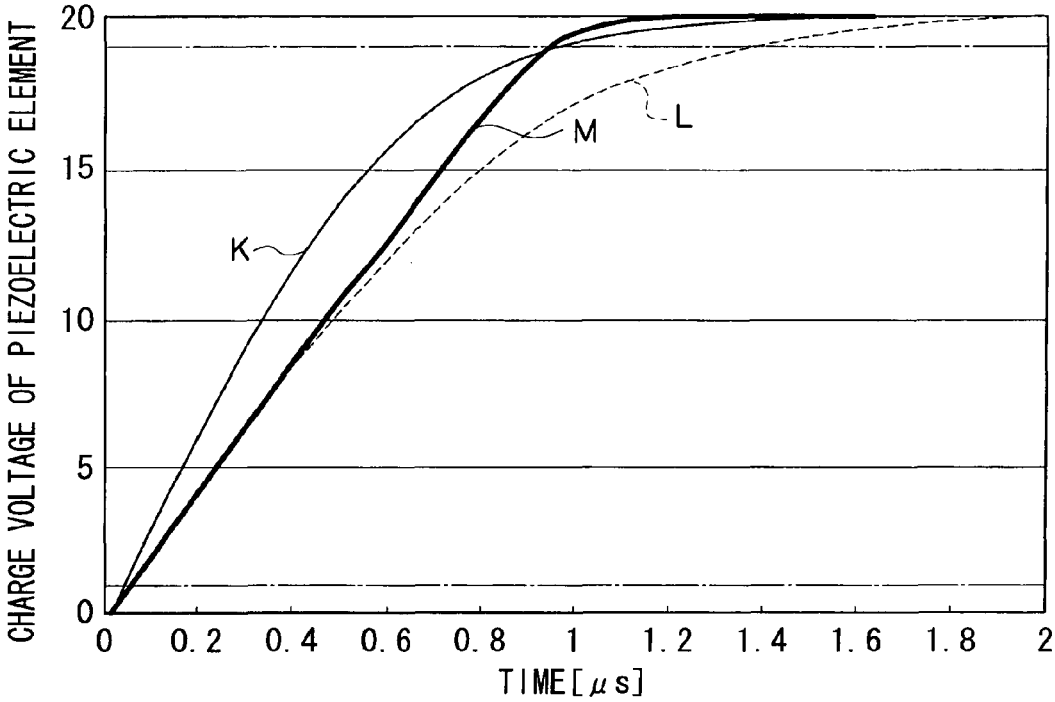
FIG. 7 is a diagram showing a state of an initial stage change including a rise time of charge voltage of a piezoelectric element.

As a result, the charge voltage having a rapid slope shown by K in FIG. 7 is applied to the piezoelectric element, which allows the rise time to be set at 0.9 μs. However, because the passage of the charge current through the piezoelectric element is proportional to the gradient of the charge voltage, a charge current with a large current value at the instant of starting the charge is passed, as shown by K in FIG. 8, which generates various harmful effects.

Figure 8:
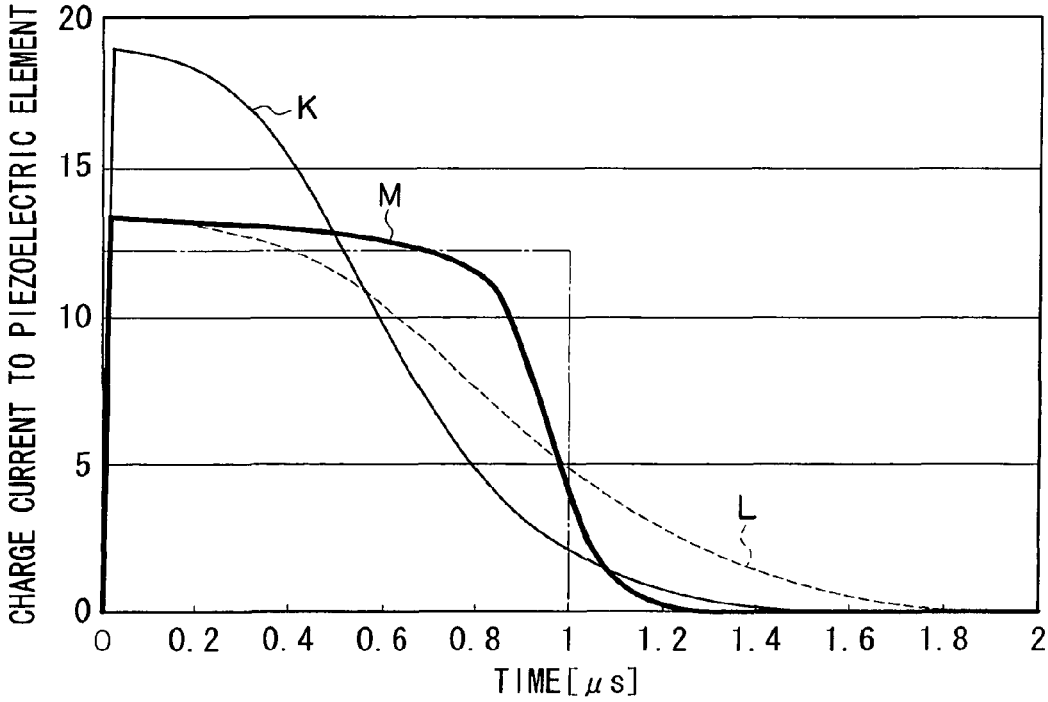
FIG. 8 is a diagram showing a state of an initial stage of charge current change including the rise time of the charge voltage of the piezoelectric element.

When a rate of increase of the charge voltage is decreased in order to suppress the initial charge instant current value, the initial charge instant current value can be suppressed as shown by L in FIG. 8. However, as shown by L in FIG. 7, the rise time becomes 1.4 μs which is longer than 0.9 μs.

On the contrary, in the first embodiment, as described above, the maximum potential is the application voltage HV1, and the control signal having an amplitude smaller than that of the application voltage HV1 is outputted to the gate of the PMOS. Therefore, as shown by M in FIG. 7, a charge voltage having a gentle gradient is applied to the piezoelectric element 30, which allows the rise time to be set at 0.9 μs. Further, as shown by M in FIG. 8, the initial charge instant current value can be suppressed to a small value.

The principle according to which the initial charge instant current value can be suppressed to a small value while the rise time can be set at 0.9 μs by outputting a control signal having an amplitude smaller than that of the application voltage HV1 to the gate of PMOS, is as follows.

Figure 9:
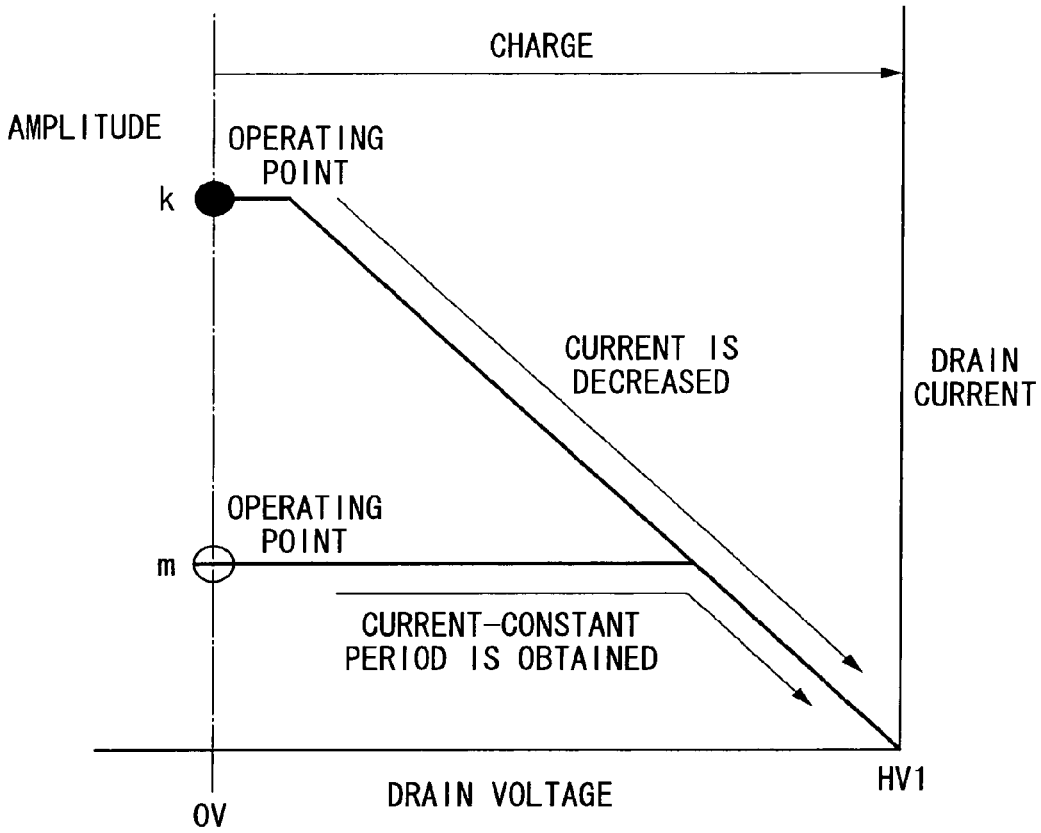
FIG. 9 is an explanatory diagram showing a principle of the embodiments of the present invention.

FIG. 9 shows general characteristics of a transistor including PMOS. As shown in FIG. 9, when a control signal having an amplitude equal to amplitude k of the application voltage HV1 is inputted to the gate of the transistor, the impedance of the transistor becomes relatively small. As a result, a large drain current is passed when inputting the control signal, and the drain current is gradually decreased until the piezoelectric element has been charged (until the voltage of the piezoelectric element has reached the application voltage HV1).

However, when a control signal having amplitude m, which is smaller than amplitude k, is inputted, the transistor impedance can be relatively large due to the general characteristics of the transistor. As a result, the drain current becomes small. In particular, as shown in FIG. 9, the drain current is kept constant until the drain voltage (charge voltage of piezoelectric element 30) has become a constant value.

In the case where the discharge is performed after the piezoelectric element 30 is charged as described above, the low-voltage buffer 54 outputs the control signal to NMOS 52B, and the piezoelectric element 30 discharges to GND through NMOS 52B. The control signal outputted from the low-voltage buffer 54 to NMOS 52B may similarly be operated by decreasing the amplitude.

As described above, in the first embodiment, since the control signal having an amplitude smaller than that of the application voltage is inputted to the transistor gate, the transistor impedance can be increased, and the instant passage of the current through the transistor can be decreased when charging the piezoelectric element.

Next, modifications of the embodiment will be described.

Figure 10:
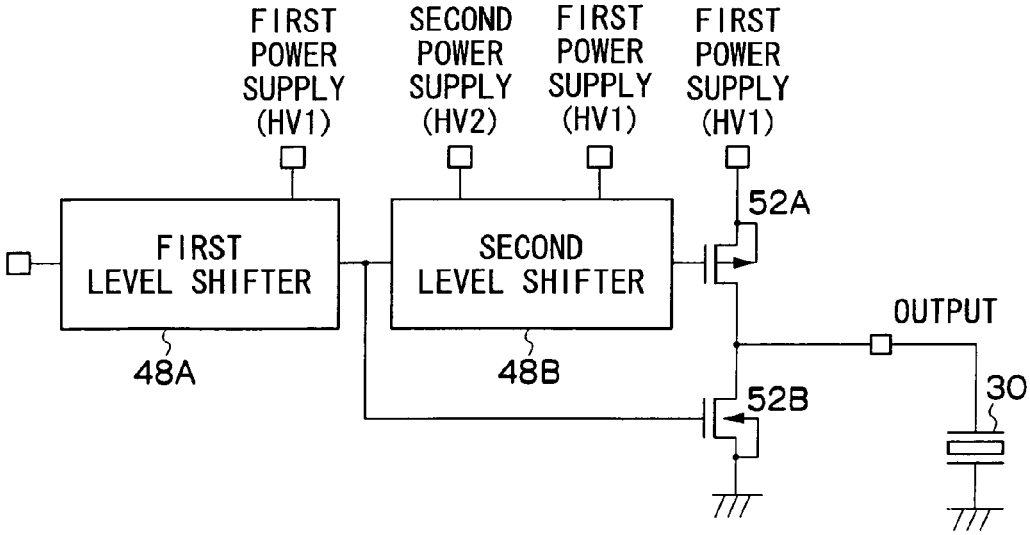
FIG. 10 is a partial block diagram of a first variant example.
Figure 11:
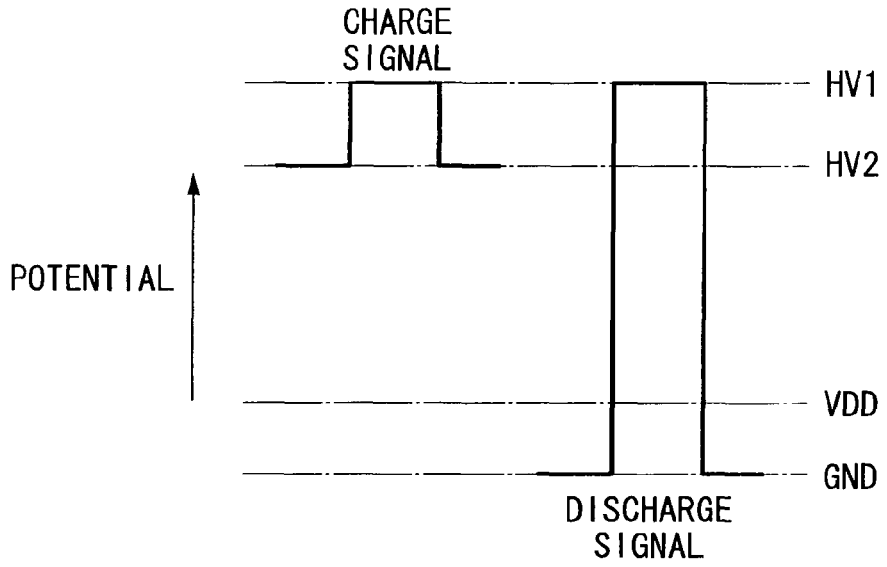
FIG. 11 is a view showing a signal change in the first variant example.

In a first modification, the low-voltage buffer 54 (see FIG. 3) in the first embodiment is omitted as shown in FIG. 10, and the NMOS 52B outputs a control signal having the same amplitude as the application voltage HV1 as shown in FIG. 11.

Figure 12:
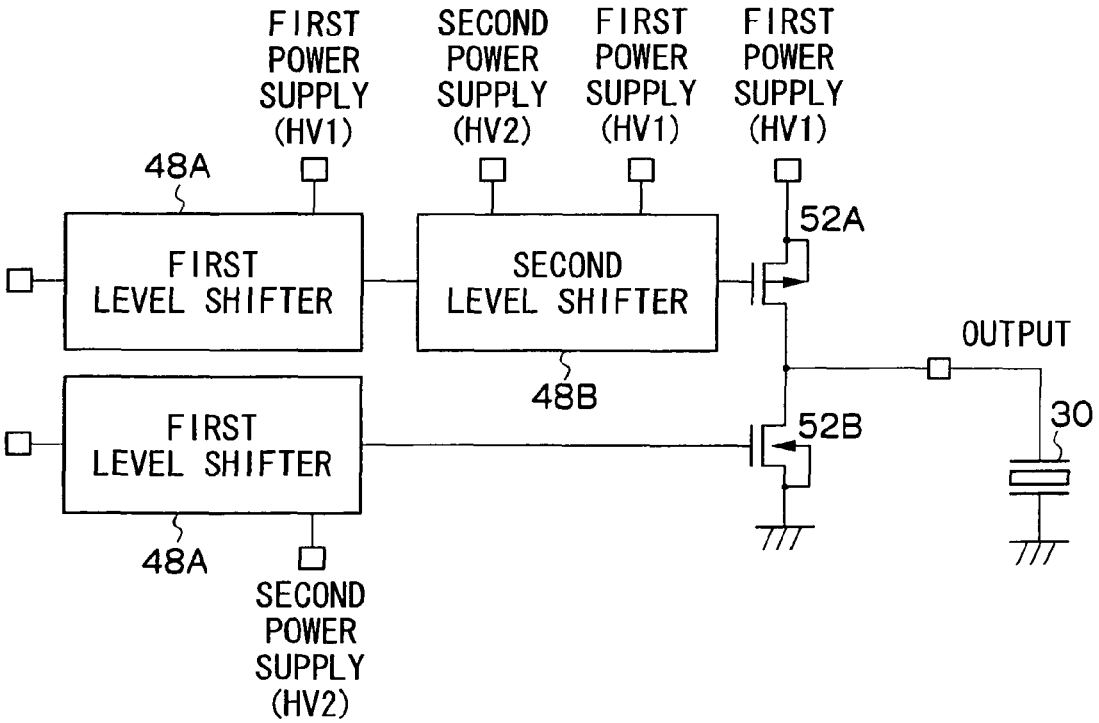
FIG. 12 is a partial block diagram of a second variant example.
Figure 13:
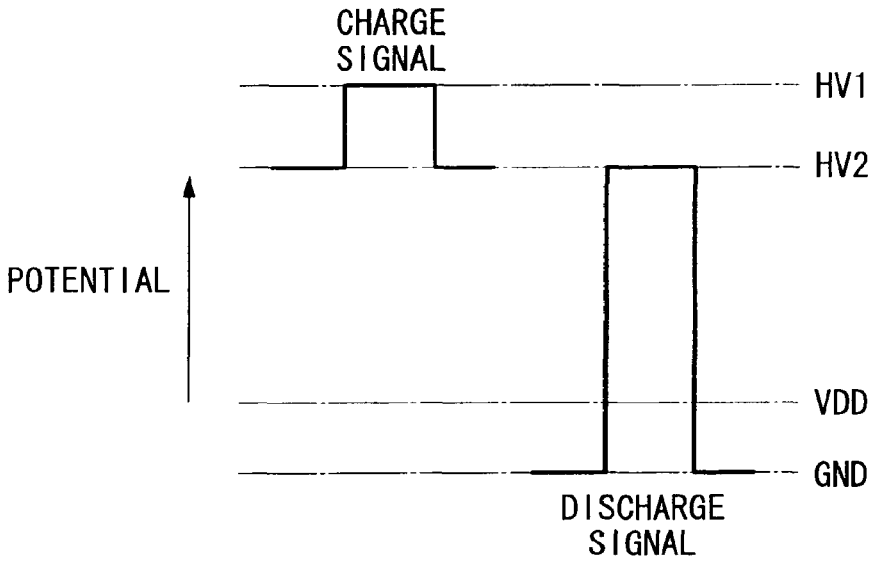
FIG. 13 is a view showing a signal change in the second variant example.

In a second modification, the first level shifter 48A is used instead of the low-voltage buffer 54 (see FIG. 3) of the first embodiment, as shown in FIG. 12, and a control signal having the amplitude of the voltage HV2, which is smaller than the application voltage HV1, is outputted to the NMOS 52B.

Next, a second embodiment and a third embodiment of the present invention will be described. As described in detail below, the configurations of the second embodiment and the third embodiment are substantially similar to the first embodiment, so that different parts will mainly be described.

In the first embodiment, the impedance of the PMOS 52A is increased when the piezoelectric element is driven. On the other hand, the second embodiment and the third embodiment differ from the first embodiment in that the impedance of the PMOS 52A is increased before the piezoelectric element is driven.

Figure 14:
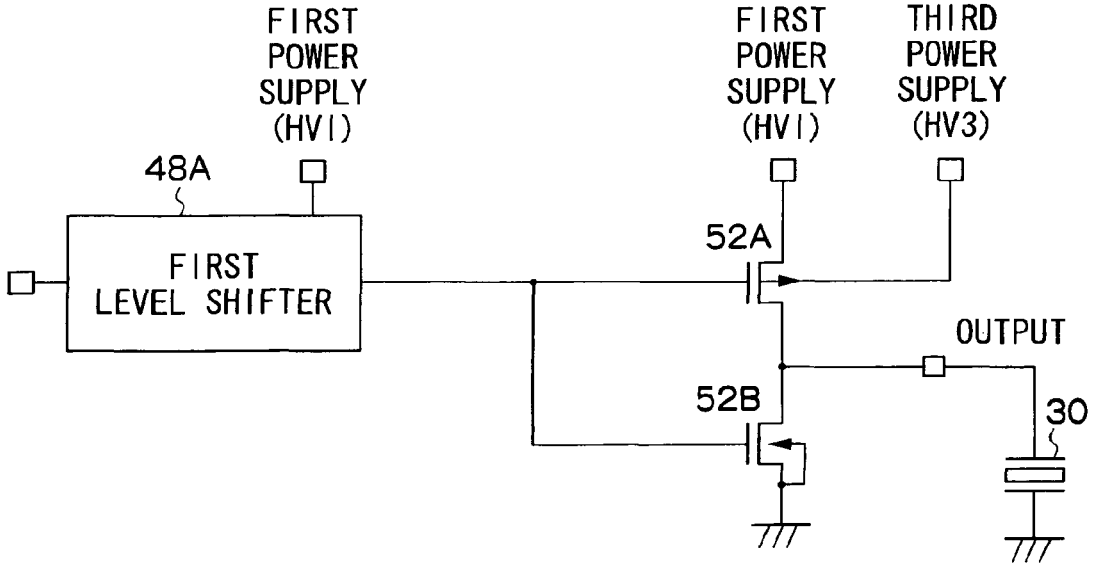
FIG. 14 is a partial block diagram according to a second embodiment of the present invention.

In the second embodiment, as shown in FIG. 14, the impedance of PMOS 52A is increased by increasing the reference potential of the PMOS 52A with a third power supply which applies a voltage HV3, which is higher than the voltage HV1.

Figure 15:
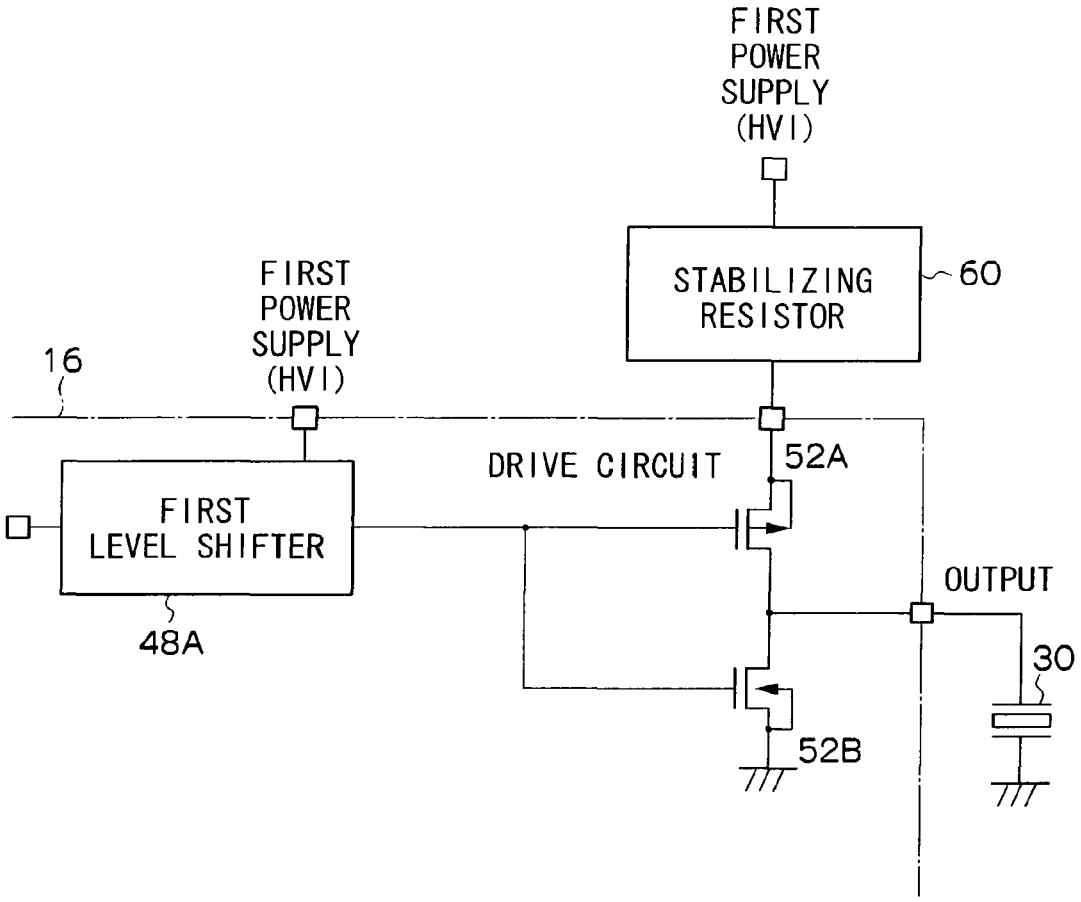
FIG. 15 is a partial block diagram according to a third embodiment of the present invention.

In the third embodiment, as shown in FIG. 15, the voltage is applied to the PMOS 52A while the power supply voltage HV1 is divided by placing a stabilizing resistor 60 between the first power supply and the driving IC 16. That is, the source-drain voltage of the PMOS 52A is decreased to be lower than the application voltage HV1, which increases the impedance of the PMOS 52A in an equivalent manner.

The principle by which the impedance of the PMOS 52A can be increased in an equivalent manner by the above configuration of the third embodiment will be described. In the third embodiment, the piezoelectric element (capacitor C), the PMOS 52A, and the stabilizing resistor 60 constitute a CR series circuit. The R portion in the CR series circuit forms a combined resistor of "stabilizing resistor+on-resistor of PMOS 52A". When the piezoelectric element is charged from zero volts to HV1, the voltage HV1 is directly applied to the combined resistor R because initially the potential of the piezoelectric element is zero volts. However, since the combined resistor is a series resistor of the stabilizing resistor and the on-resistor of the PMOS 52A, the voltage applied between the source and the drain of the PMOS 52A is lower than HV1, and the source-drain voltage of the PMOS 52A is determined by a voltage division ratio based on the resistor values of the stabilizing resistor and the on-resistor of the PMOS 52A. Because the potential of the piezoelectric element is increased as the charge progresses, the voltage applied to the combined resistor is decreased. However, the voltage applied between the source and the drain of the PMOS 52A is lower than the voltage applied to the combined resistor, and the source-drain voltage of the PMOS 52A is determined by the voltage division ratio at that time. Thus, the voltage applied between the source and the drain of the PMOS 52A is decreased by the voltage divided by the stabilizing resistor, so that the configuration of the third embodiment can be regarded as equivalent to an increase in the impedance of the PMOS 52A.

In the above embodiments, ink is used as the droplet. However, the present invention is not limited to ink. For example, a reactive solution can be used instead of ink. Specifically, there is a phenomenon where density is changed by an applied amount of reactive solution, and the invention can similarly be applied in controlling fluctuations in density of the reactive solution. Further, the invention can similarly be applied to the application of an oriented film forming material for a liquid crystal element, the application of flux, the application of a bonding agent, and the like by the inkjet method.

As described above, the first embodiment of the invention is a droplet ejecting component including an ejecting component which ejects a droplet, the ejecting component having a charge and discharge characteristic; an applying component which applies an application voltage to the ejecting component when a control signal is inputted, the applying component being provided with a transistor; and an increasing component which increases the impedance of the transistor.

The ejecting component is a component that ejects a droplet while having a charge and discharge characteristic. The applying component is provided with the transistor, and the applying component applies the application voltage to the ejecting component when a control signal is inputted. The increasing component increases the transistor impedance.

As used herein, "transistor impedance is increased" shall include the case in which the transistor impedance itself is increased and the case in which the input voltage amplitude of the transistor is decreased to obtain a resultant increase in transistor impedance.

Thus, when the transistor impedance is increased in the applying component, the instant passage of the current through the ejecting component via the transistor can be decreased when driving the ejecting component.

The increasing component increases the transistor impedance when driving the ejecting component.

The increasing component may input to the applying component a control signal having an amplitude smaller than that of the application voltage. In the control signal, the maximum potential may be equal to or higher than the maximum potential of the application voltage, and the minimum potential may be higher than the minimum potential of the application voltage. In order to generate the control signal, the increasing component may include a first potential converting component and a second potential converting component. When the drive instruction signal for driving the ejecting component is inputted, the first potential converting component converts the maximum potential of the drive instruction signal into a potential that is not lower than the maximum potential of the application voltage. The second potential converting component converts the minimum potential of the drive instruction signal, in which the maximum potential is converted by the first potential converting component, into a potential larger than the minimum potential of the application voltage.

In the invention, the transistor impedance may be increased when driving the ejecting component as described above, and the transistor impedance may be increased before the ejecting component is driven as described below.

In order to increase the transistor impedance before the ejecting component is driven, the increasing component may in advance set the reference potential of the transistor so as to be out of the application voltage range, or the increasing component may substantially decrease the voltage applied to the transistor output. As a result, the transistor impedance can be increased.

As described above, in the present invention, the transistor impedance is increased in the applying component. Therefore, the instant passage of the current through the ejecting component via the transistor can be decreased when driving the ejecting component.

What is claimed is:

1. A droplet ejecting apparatus comprising:

an ejecting component which ejects a droplet, the ejecting component having a charge and discharge characteristic;

an applying component which applies an application voltage to the ejecting component when a control signal is inputted, the applying component being provided with a transistor; and an increasing component which increases the impedance of the transistor, wherein the increasing component increases the impedance of the transistor before the ejecting component is driven, and the increasing component substantially decreases a voltage applied to an output of the transistor.

2. A current control method in which passage of current through an ejecting component is controlled in a starting drive of a droplet ejecting apparatus including the ejecting component, an applying component, and an increasing component, wherein the ejecting component has a charge and discharge characteristic, and the ejecting component ejects a droplet, the applying component is provided with a transistor, the applying component applies an application voltage to the ejecting component when a control signal is inputted, and the increasing component increases the impedance of the transistor, wherein the increasing component increases the impedance of the transistor before the ejecting component is driven, and the increasing component substantially decreases a voltage applied to an output of the transistor.

* * * * *